US007540169B2

(12) United States Patent
Kwon

(10) Patent No.: US 7,540,169 B2
(45) Date of Patent: Jun. 2, 2009

(54) COLD AIR SUPPLY AND CONTROL DEVICE FOR REFRIGERATOR

(75) Inventor: Yong Chol Kwon, Changwon (KR)

(73) Assignee: LG Electronics Inc., Seoul (KR)

( * ) Notice: Subject to any disclaimer, the term of this patent is extended or adjusted under 35 U.S.C. 154(b) by 393 days.

(21) Appl. No.: 11/400,244

(22) Filed: Apr. 10, 2006

(65) Prior Publication Data

US 2006/0225452 A1 Oct. 12, 2006

(30) Foreign Application Priority Data

Apr. 11, 2005 (KR) ..... 10-2005-0030095

(51) Int. Cl.

| | |
|---|---|
| ***F25D 17/04*** | (2006.01) |
| ***F25D 17/06*** | (2006.01) |
| ***F24F 7/00*** | (2006.01) |
| ***F24F 13/10*** | (2006.01) |
| ***F24F 13/12*** | (2006.01) |
| ***F24F 13/08*** | (2006.01) |

(52) U.S. Cl. ..... 62/407; 62/414; 62/419; 62/426; 62/255; 62/408; 454/274; 454/273; 454/298; 454/323; 454/324; 454/334; 454/319; 454/363

(58) Field of Classification Search ..... 62/255, 62/407, 408, 414, 419, 426; 454/273, 274, 454/298, 319, 323, 324, 334, 363
See application file for complete search history.

(56) References Cited

U.S. PATENT DOCUMENTS 5,029,810 A * 7/1991 Finnerty ..... 251/299
5,092,137 A * 3/1992 Elsom ..... 62/408
5,315,846 A * 5/1994 Lee ..... 62/419
5,722,252 A * 3/1998 Kang et al. ..... 62/455
5,884,496 A * 3/1999 Kim et al. ..... 62/186
6,059,653 A * 5/2000 Gehring et al. ..... 454/155
6,800,024 B1 * 10/2004 Prevost ..... 454/290

FOREIGN PATENT DOCUMENTS

KR 20-1997-0000045 1/1997

OTHER PUBLICATIONS

Machine Translation of the examined Korean Patent Application KR 20-1997-0000045 to Lee.*

* cited by examiner

*Primary Examiner*—Cheryl J Tyler
*Assistant Examiner*—Filip Zec
(74) *Attorney, Agent, or Firm*—Ked & Associates LLP

(57) ABSTRACT

A cold air supply and control device for a refrigerator is provided. The cold air supply and control device includes a cylindrical, duct main body having an inlet that allows cold air generated in a heat exchange chamber to be introduced thereinto and an outlet that supplies the cold air introduced through the inlet to a refrigerating chamber. The duct main body is pivotably installed to at least one of both side surfaces of the refrigerating chamber. An opening and closing piece is fixed to the side surface of the refrigerating chamber and selectively opens and closes the outlet according to a rotation of the duct main body. An interlocking plate formed below the outlet of the duct main body rotates the duct main body by a load of a shelf so as to open the outlet. In addition, a torsion spring is installed between a surface of the refrigerating chamber and a front or rear surface of the duct main body, and elastically supports the duct main body in a direction in which the outlet is closed.

18 Claims, 5 Drawing Sheets

COLD AIR SUPPLY AND CONTROL DEVICE FOR REFRIGERATOR

This application claims the benefit of Korean Patent Application No. 10-2005-0030095 filed Apr. 11, 2005, which is hereby incorporated by reference as set forth herein.

BACKGROUND OF THE INVENTION

1. Field of Invention

The present invention relates to a refrigerator, and more particularly, to a cold air supply device for a refrigerator capable of supplying cold air directly to stored goods when the stored goods are put on a shelf in a storage space of the refrigerator.

2. Description of the Prior Art

A refrigerator includes a storage space for keeping food to be stored in a refrigerated or frozen state. The storage space is supplied with cold air that is generated through contact of air with a heat exchanger of a freezing cycle.

FIG. 1 is a longitudinal sectional view showing the interior of a general refrigerator. As shown in the figure, a refrigerator main body 2 comprises an outer case 4*a* of a steel plate and an inner case 4*b* installed inside the outer case 4*a*. In addition, an insulating material 6 is provided between the outer case 4*a* and the inner case 4*b*.

Further, the interior of the refrigerator main body 2 is formed to be divided into a refrigerating chamber 8*a* and a freezing chamber 8*b* that are storage spaces. Refrigerating and freezing chamber doors 10*a* and 10*b* are installed at front faces of the refrigerating and freezing chambers 8*a* and 8*b*, respectively. The doors 10*a* and 10*b*, which are installed pivotably about their respective sides that are supported by the refrigerator main body 2, selectively open and close the refrigerating and freezing chambers 8*a* and 8*b*, respectively.

The refrigerating and freezing chambers 8*a* and 8*b* are partitioned with a barrier 12. An insulation layer is also provided in the barrier 12. In the illustrated example of the prior art, a cold air connecting passage 14 is formed in the barrier 12. The cold air connecting passage 14 allows the cold air to be supplied into the refrigerating chamber 8*a*.

A heat exchange chamber 16 is provided at a rear portion of the freezing chamber 8*b* and an evaporator 18 is installed in the heat exchange chamber 16. A refrigerant channel (not shown) is formed in the evaporator 18. While a liquid refrigerant at low temperature and pressure is introduced into and flows in the refrigerant channel, the refrigerant is evaporated through heat exchange with the surrounding air, and the evaporated refrigerant flows to a compressor (not shown). Since the liquid refrigerant absorbs surrounding heat while flowing within the evaporator 18, the air in contact with a surface of the evaporator 18 is changed into cold air. The cold air thus generated is supplied to the aforementioned refrigerating and freezing chambers 8*a* and 8*b*, so that it is possible to keep the stored food in a refrigerated and frozen state.

For example, the cold air generated in the heat exchange chamber 16 is supplied to the refrigerating and freezing chambers 8*a* and 8*b* by a blowing fan 17. The freezing chamber 8*b* is directly supplied with the cold air by the blowing fan, while the refrigerating chamber 8*a* is directly supplied with the cold air through the cold air connecting passage 14 formed in the barrier 12 between the heat exchange chamber 16 and the refrigerating chamber 8*a*. In addition, for example, side ducts 20 are installed on both side surfaces of the refrigerating chamber 8*a*.

Thus, the cold air subjected to the heat exchange in the heat exchange chamber 16 is supplied to the side ducts 20 through the cold air connecting passage 14 in the barrier 12, and the cold air supplied to the side ducts 20 is then supplied to the refrigerating chamber 8*a* through cold air discharge ports 22 formed in the side ducts 20. When the cold air is supplied to the refrigerating chamber 8*a*, the refrigerating chamber 8*a* is maintained in a low temperature state, and thus, goods and the like to be stored can be kept in the refrigerating chamber 8*a*.

However, the conventional refrigerator has the following problems.

That is, in the prior art, when the interior of the storage space is supplied with the cold air, it is impossible to control the amount of cold air to be discharged through the air discharge ports 22. In other words, the cold air is merely supplied into the storage space through the cold air discharge ports 22 after checking temperature in the storage space. That is, the cold air is supplied into the storage space through the cold air discharge ports 22 regardless of the presence of stored goods near the cold air discharge ports 22. In such a case, there is a problem in that it is impossible to keep the stored goods fresh since the cold air cannot be supplied intensively to a portion, which requires the cold air, in an efficient manner.

SUMMARY OF THE INVENTION

According to the prior art, cold air is uniformly supplied throughout a refrigerating chamber. However, for example, in a case where a plenty of stored goods are put on a portion of a shelf installed in the refrigerating chamber and stored goods are not put on another portion of the shelf, it will be apparent that intensive supply of the cold air to the portion on which a plenty of stored goods are put is effective.

Accordingly, the present invention is conceived to solve the aforementioned problems in the prior art. An object of the present invention is to provide a cold air supply and control device for a refrigerator capable of intensively and selectively cooling only a shelf on which stored goods are put.

Another object of the present invention is to provide a cold air supply and control device capable of achieving uniform refrigeration by directly supplying a shelf with cold air corresponding to the amount of food put on the shelf.

A further object of the present invention is to provide a cold air supply and control device capable of rapidly refrigerating newly input food by supplying cold air directly to the newly input food.

According to an aspect of the present invention for achieving the objects, there is provided a cold air supply and control device for a refrigerator, including a heat exchange chamber equipped with a heat exchanger to generate cold air, a refrigerating chamber for storing stored goods using the cold air from the heat exchange chamber, and a plurality of shelves installed in the refrigerating chamber. The cold air supply and control device comprises a duct main body having an inlet for allowing the cold air generated in the heat exchange chamber to be introduced thereinto and an outlet for supplying the cold air introduced through the inlet to the refrigerating chamber; and an opening/closing means for opening and closing the outlet of the duct main body in response to a load applied to the shelf.

In addition, the outlet is preferably formed at a position suitable for supplying the cold air toward an upper portion of the shelf.

According to another aspect of the present invention, there is provided a cold air supply and control device for a refrigerator, including a heat exchange chamber equipped with a heat exchanger to generate cold air, a refrigerating chamber for storing stored goods using the cold air from the heat exchange chamber, and a plurality of shelves installed in the refrigerating chamber. The cold air supply and control device comprises a duct main body that has an inlet for allowing the cold air generated in the heat exchange chamber to be introduced thereinto and an outlet for supplying the cold air introduced through the inlet to the refrigerating chamber and is pivotably installed to at least one of both side surfaces of the refrigerating chamber; a support means for supporting the shelf; and an opening/closing means for opening and closing the outlet by rotating the duct main body by a load of the shelf applied to the support means.

According to a further aspect of the present invention, there is provided a cold air supply and control device for a refrigerator, including a heat exchange chamber equipped with a heat exchanger to generate cold air, a refrigerating chamber for storing stored goods using the cold air from the heat exchange chamber, and a plurality of shelves installed in the refrigerating chamber. The cold air supply and control device comprises a duct main body that has an inlet for allowing the cold air generated in the heat exchange chamber to be introduced thereinto and an outlet for supplying the cold air introduced through the inlet to the refrigerating chamber and is pivotably installed on at least one of both side surfaces of the refrigerating chamber; an opening/closing piece fixed to the side surface of the refrigerating chamber so as to selectively open and close the outlet in response to rotation of the duct main body; an opening/closing means for rotating the duct main body in response to the weight of food put on the shelf in a direction in which the outlet is opened by the opening/closing piece; and an elastic means for rotating the duct main body in a direction in which the outlet is closed by the opening/closing piece.

The opening/closing means may comprise an interlocking plate which is formed below the outlet of the duct main body and on which the shelf is seated, so that the opening/closing means rotates the duct main body in the direction in which the outlet is opened by the weight of the food put on the shelf.

The elastic means may comprise a torsion spring installed between a front or rear surface of the duct main body and a corresponding surface of the storage space.

Further, the duct main body is preferably formed in a fore and check aft direction on the side surface of the refrigerating chamber. More preferably, the duct main body is installed in a mount groove portion with an arcuate cross section that is concavely formed in the side surface of the refrigerating chamber.

Preferably, the duct main body is installed pivotably on its pivotal shaft.

Furthermore, the inlet is preferably formed in a rear surface of the duct main body, and the outlet is preferably formed in a side surface of the duct main body to supply the cold air toward the shelf.

The cold air supply and control device may further comprise a shelf support portion formed on the side surface of the storage space at a position corresponding to a lower portion of the interlocking plate to support the shelf in a state where the outlet of the duct main body is fully opened.

In this embodiment, the outlet is preferably formed to supply the cold air toward an upper portion of the shelf, and more preferably, to extend in a fore and aft direction corresponding to the shelf.

According to the present invention, it is possible to supply the cold air directly toward the upper portion of the shelf when food is put on the shelf, while it is possible to stop supplying the cold air when no food is put on the shelf. Thus, it is possible to obtain efficient refrigerating effects. This makes it possible to intensively supply the cold air to a new load, which means that the effects of rapid and uniform refrigeration can be obtained.

According to the cold air supply and control device of the present invention thus configured, since the cold air can be intensively supplied to only a shelf on which stored goods are put, it is possible to expect an advantage of efficient refrigerating and freezing storage. In addition, since the opening degree of the cold air discharge port and thence the amount of supplied cold air can be controlled according to the weight of the stored goods put on the shelf, there is an advantage in that it is possible to effectively refrigerate the stored goods according to the degree of a load.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE PREFERRED EMBODIMENT

Hereinafter, a cold air supply and control device for a refrigerator according to a preferred embodiment of the present invention will be described in detail with reference to the accompanying drawings.

Figure 1:
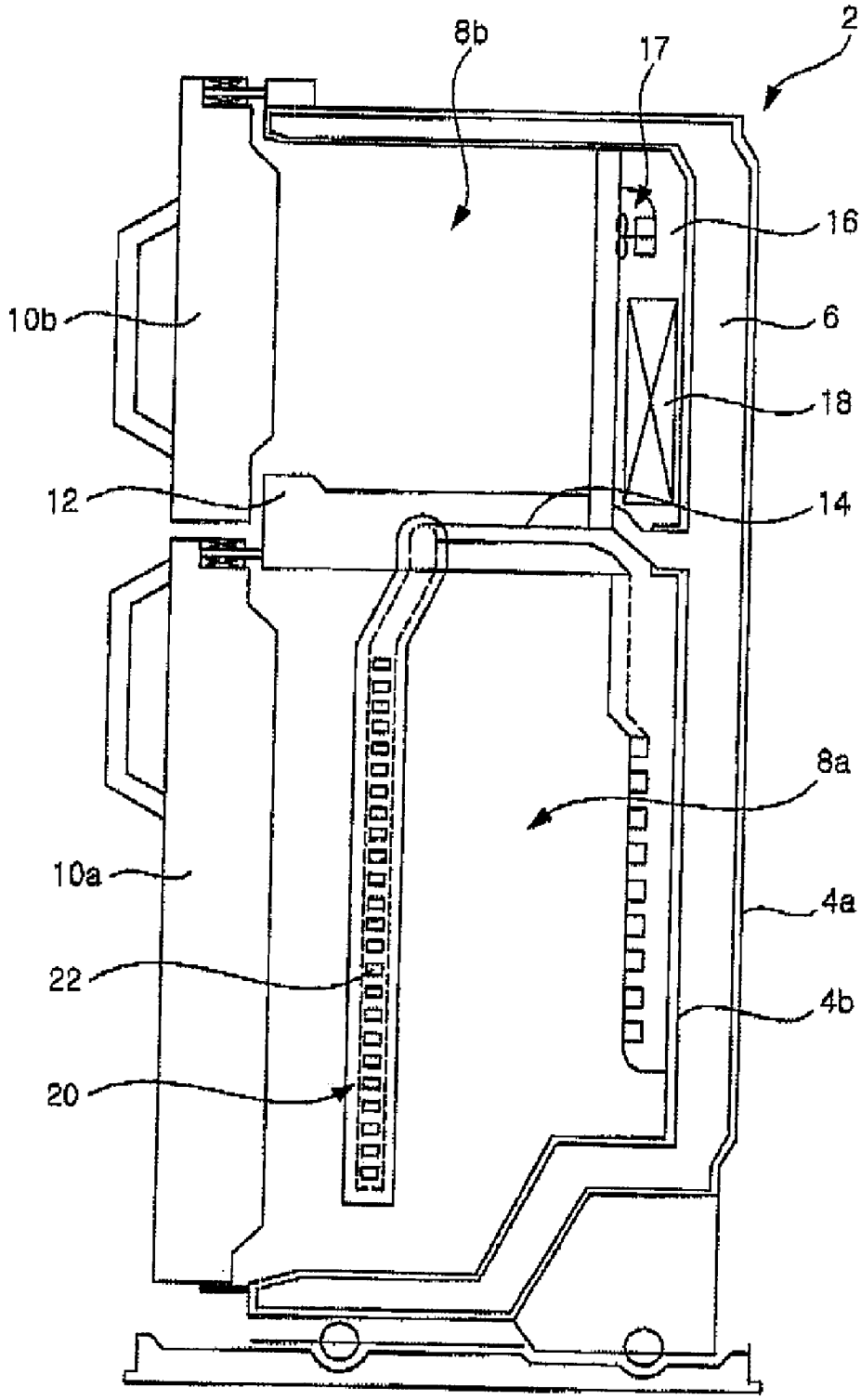
FIG. 1 Conventional Art
FIG. 1 is a side sectional view showing an inner configuration of a conventional refrigerator.
Figure 2:
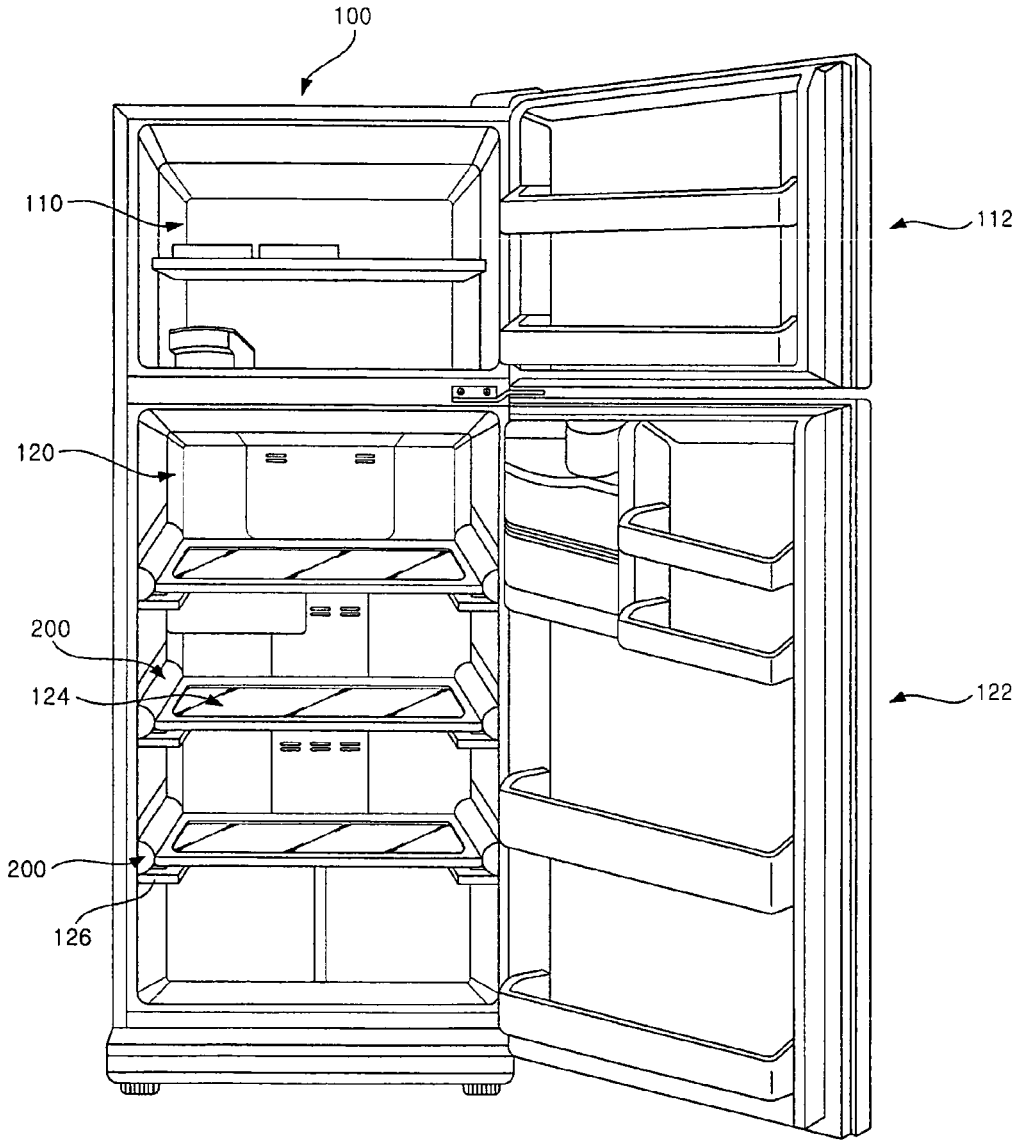
FIG. 2 is a perspective view of a refrigerator in which a cold air supply and control device according to a preferred embodiment of the present invention is employed.
Figure 3:
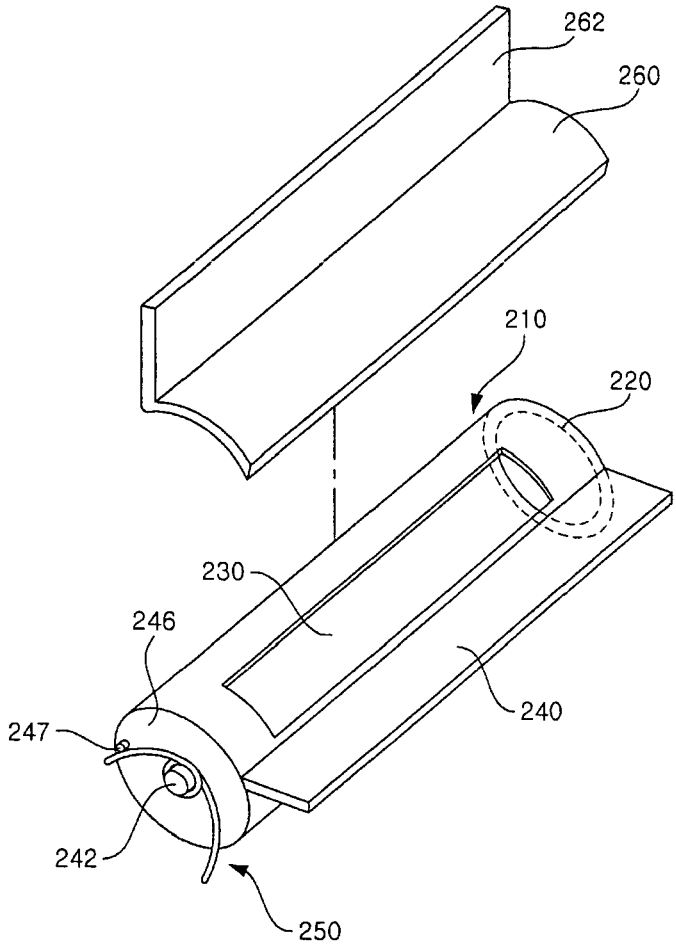
FIG. 3 is an exploded perspective view showing the cold air supply device of the present invention.
Figure 4:
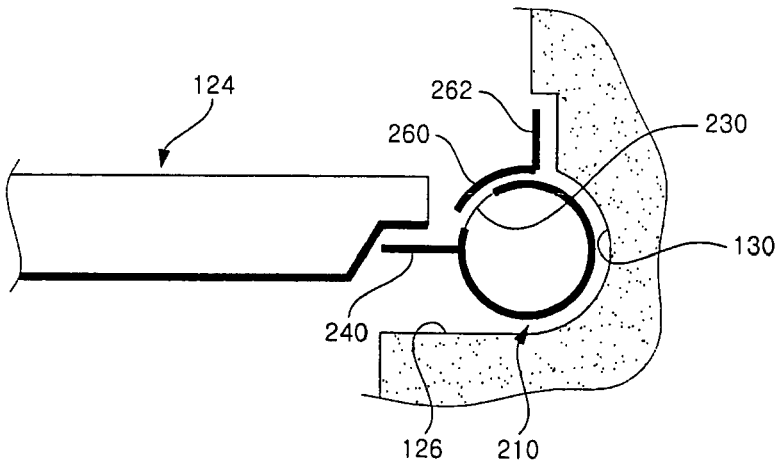
FIG. 4 is a side sectional view of the cold air supply device of the present invention.
Figure 5:
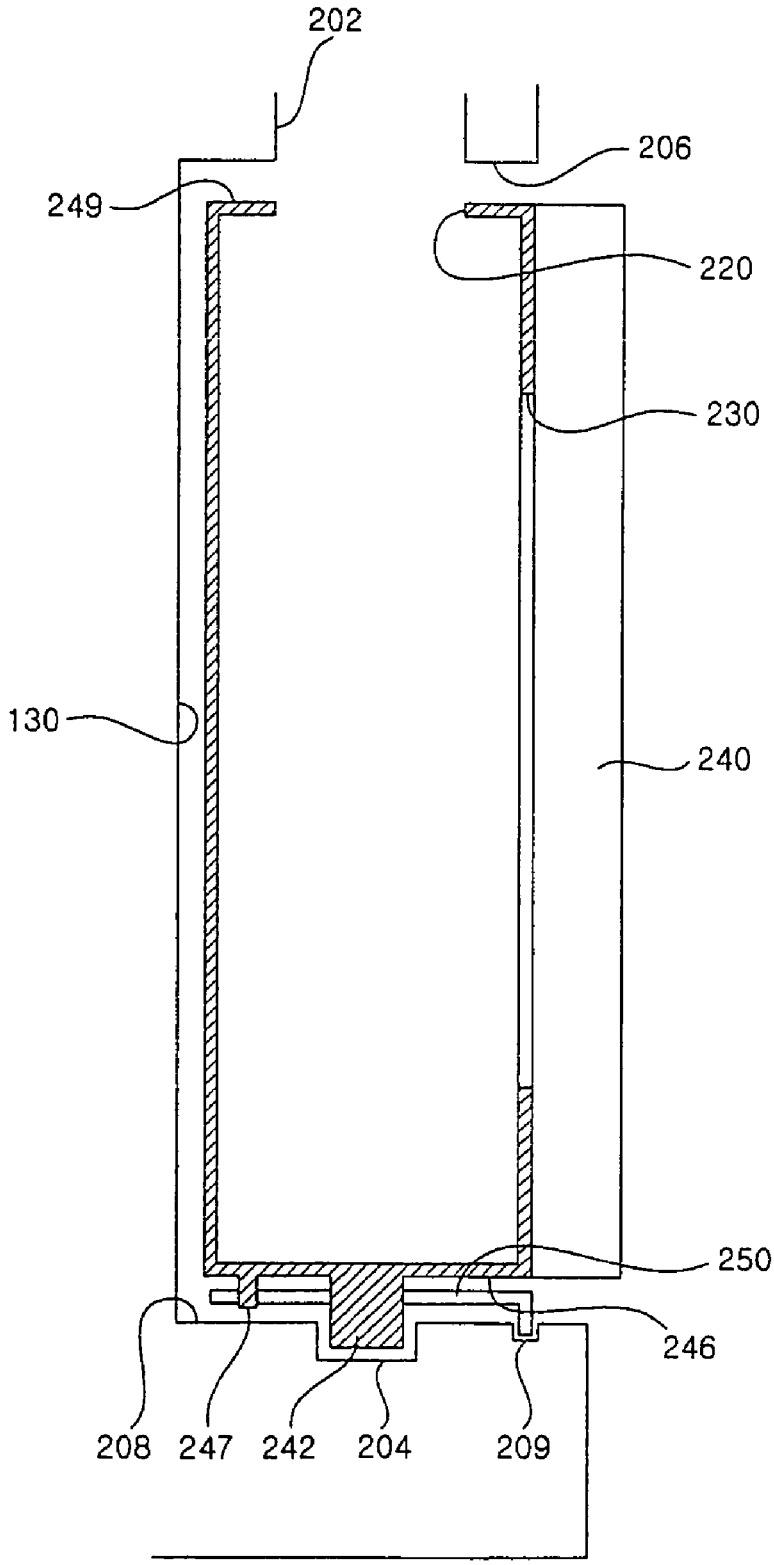
FIG. 5 is a longitudinal sectional view of the cold air supply device of the present invention.

FIG. 2 is a perspective view of a refrigerator in which a cold air supply and control device according to a preferred embodiment of the present invention is employed, FIG. 3 is an exploded perspective view showing the cold air supply device according to the embodiment of the present invention, and FIG. 4 is a side sectional view of the cold air supply device according to the embodiment of the present invention, and FIG. 5 is a longitudinal sectional view of the cold air supply device of the present invention.

Referring to these figures, freezing and refrigerating chambers 110 and 120 with open front faces are provided in a refrigerator main body 100. In addition, the freezing and refrigerating chambers 110 and 120 are opened and closed by freezing and refrigerating chamber doors 112 and 122, respectively.

A plurality of shelves 124 on which food can be put are installed in the refrigerating chamber 120 at predetermined intervals. In this regard, the freezing chamber 110 has the same structure as the refrigerating chamber. The shelves 124 are configured to be supported by shelf support portions 126 installed on both sidewalls of the refrigerating chamber 120. The shelf support portions 126 may be formed, for example, integrally with the sidewalls of the refrigerating chamber 120. The shelf support portions 126 function to support lower ends of both sides of each of the shelves 124. In addition to such shelf support portions 126, other configuration for horizontally supporting the shelves 124 may be applied.

On both sides of the shelf 124, there are provided cold air supply and control devices 200 capable of supplying cold air directly to the food put on the shelf. The cold air supply and control devices 200 of the present invention are installed at least one of both sidewalls of the refrigerating chamber 120 at positions corresponding to the both sides of the shelf 124 to supply the cold air directly to an upper portion of the shelf 124. In addition, the cold air supply and control device 200 according to the present invention can control the amount of supplied cold air according to the weight of the food put on the shelf 124. That is, the cold air supply and control device 200 is configured such that a large amount of cold air is supplied when much food is put on the shelf 124 and thus heavy weight is exerted thereon and a small amount of cold air is supplied when relatively less food is put on the shelf 124 and thus light weight is exerted thereon.

Next, the cold air supply and control device 200 of the present invention will be described in detail with reference to FIGS. 3 to 5.

As shown in FIG. 3, the cold air supply and control device 200 of the present invention comprises a duct main body 210 that is installed on each of the both sidewalls of the refrigerating chamber 120 and supplies cold air into the refrigerating chamber 120. That is, the duct main bodies 210 are installed on the both sidewalls of the refrigerating chamber at positions corresponding to the both sides of the shelf 124, so that the duct main bodies can supply the cold air directly to food stored on the shelf 124.

The duct main body 210 may be formed in a cylindrical shape as in the illustrated embodiment. The formation of the duct main body 210 in the cylindrical shape is to prevent interference with a mount groove portion 130 when the duct main body 210 pivots therein, as will be described below. That is, in the illustrated embodiment, the mount groove portion 130 is formed to have an arcuate cross section so that the cylindrical, duct main body 210 is pivotably supported in the mount groove portion 130. In addition, the duct main body 210 includes an inlet 220 through which the cold air generated by means of heat exchange in a heat exchange chamber of the refrigerator is introduced into the duct main body 210, and an outlet 230 for discharging the cold air introduced through the inlet 220 into the refrigerator.

The inlet 220 is connected to and communicates with a cold air supply duct 202. The cold air supply duct 202 is a passage for use in supplying the cold air that is generated by means of contact of air with an evaporator in the heat exchange chamber provided in the rear of the freezing chamber. The cold air supply duct 202 is formed from the heat exchange chamber to the inlet of the duct main body 210 through the interior of the refrigerator main body.

The inlet 220 of the duct main body is formed in a rear face 249 of the cylindrical, duct main body 210, and the outlet 230 is formed in a side surface of the duct main body 210. As shown in FIG. 5, the inlet 220 is installed to communicate with an end of the cold air supply duct 202 formed in each of both sidewalls of the refrigerator, and thus allows the cold air to be introduced into the duct main body 210 through the cold air supply duct 202.

The outlet 230 is formed to discharge the cold air, which is introduced into the duct main body 210 through the inlet 220, into the refrigerating chamber. The outlet 230 is formed in the side surface of the duct main body 210 and allows the cold air to be discharge to the upper portion of the shelf 124 in the refrigerating chamber. It is preferred that the outlet 230 be formed to extend in a fore and aft direction corresponding to the length of the shelf in the fore and aft direction, so that the cold air can be uniformly supplied throughout food or the like put on the shelf 124. Further, in the illustrated embodiment, the outlet 230 is formed in a rectangular shape that extends in the fore and aft direction.

An interlocking plate 240 is formed below the outlet 230. The interlocking plate 240 is formed to extend in the fore and aft direction on the side surface of the duct main body 210. An upper surface of the interlocking plate 240 is a portion on which each of both side ends of the shelf is seated and causes the duct main body 210 to be rotated by the weight of the food put on the shelf 124.

The duct main bodies 210 are pivotably supported on the both side surfaces of the refrigerating chamber of the refrigerator. In the illustrated embodiment, the mount groove portions 130 are concavely formed in the both sidewalls of the refrigerating chamber 120 adjacent to the shelf support portions 126. The mount groove portions 130 are formed in the both sidewalls of the refrigerating chamber 120 to extend in the fore and aft direction. The duct main body 210 is accommodated and pivotably supported in each of the mount groove portions 130.

In the illustrated embodiment, a pivotal shaft 242 is formed on a front surface of the duct main body 210. A front surface 208 of the mount groove portion 130 is formed with a support groove 204 for pivotably supporting the pivotal shaft 242. In addition, although not shown, the rear surface 249 of the duct main body 210 and a rear surface 206 of the mount groove portion 130 are provided with features for pivotably supporting the duct main body 210. For example, the rear surface 249 of the duct main body 210 may be formed with a ring-shaped protrusion around the inlet 220 and the rear surface 206 of the mount groove portion 130 may be formed with a ring-shaped support groove portion in which the ring-shaped protrusion can be pivotably accommodated. In addition to these features, it is possible to make various modifications to these features for pivotably supporting the duct main body 210 in the mount groove portion 130. Further, it is also possible to pivotably install the duct main bodies 210 at the both side surfaces of the refrigerating chamber 120.

As shown in FIGS. 3 and 5, an elastic member 250 is interposed between a front surface 246 of the duct main body 210 and the front surface 208 of the mount groove portion 130. The elastic member 250 is to provide an elastic force for elastically returning the duct main body 210 to its initial position when the duct main body has been pivoted. In the illustrated embodiment, the elastic member 250 includes a torsion spring. An end of the torsion spring 250 with a center portion fitted around the pivotal shaft 242 is caught and supported by a support protrusion 247 formed on the front surface 246 of the duct main body 210, and the other end of the torsion spring 250 is supported by a groove 209 formed in the front surface 208 or by a protrusion formed thereon, so that the torsion spring 250 can provide the elastic force for returning the duct main body 210 to its initial position. The elastic coefficient of the torsion spring 250 should be calculated appropriately. That is, the elastic coefficient should be set such that the torsion spring 250 can be elastically deformed by the weight of food when a small amount of food is put on the shelf to such an extent that the supply of the cold air is needed and can he fully elastically deformed when a predetermined or more amount of food is put on the shelf.

In addition, an opening/closing piece 260 is installed above the duct main body on each of the both side surfaces of the refrigerating chamber. The opening/closing piece 260 is installed to selectively open and close the outlet 230. In the illustrated embodiment, the opening/closing piece 260 is fixed to each of the both side surfaces of the refrigerating chamber by a fixing portion 262 extending from an upper portion of the opening/closing piece 260. The opening/closing piece 260 is formed to have a cross section in a cylindrical shape corresponding to the cylindrical, duct main body 210. In addition, a lower end of the opening/closing piece 260 is in contact with the upper surface of the interlocking plate 240. The elastic member 250 elastically urges the duct main body 210 toward a position where the outlet 230 of the duct main body 210 is closed by the opening/closing piece 260. That is, when food is put on the shelf, the weight of the food causes the duct main body 210 to pivot, thereby opening the outlet 230. On the contrary, when there is no food on the shelf, the elastic member 250 applies an elastic force to the duct main body 210 so that the outlet 230 is closed by the opening/closing piece 260.

Figure 6A:
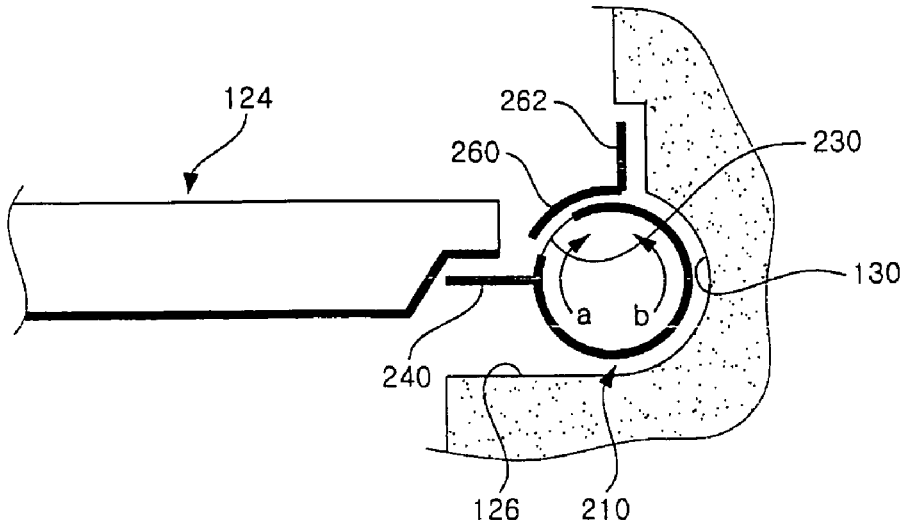
FIGS. 6*a* and 6*b* are views showing operating processes of the cold air supply device of the present invention.

Next, the operation of the cold air supply and control device according to the present invention thus configured will be described with reference to FIGS. 6*a* and 6*b*. FIG. 6*a* shows a state where food is not put on the shelf 124 and FIG. 6*b* shows a state where food is put on the shelf 124 that in turn is subjected to certain weight.

In a state where the duct main bodies 210 are installed in the mount groove portions 130, the both side ends of the shelf 124 are seated on the interlocking plates 240. Here, for the sake of convenience of illustration, the shelf support portion 126 is not shown in FIGS. 6*a* and 6*b*.

In a state where no food is put on the shelf 124, the shelf 124 is subjected to the elastic force of the elastic member 250 in a clockwise direction about the pivotal shaft 242 in the figures. Due to such an elastic force of the elastic member 250, the duct main body 210 tends to pivot in an arrow direction a, but the interlocking plate 240 is substantially maintained in a horizontal state since the interlocking plate 240 is in contact with a lower end of the opening/closing piece 260. In such a state, as shown in FIG. 6*a*, the opening/closing piece 260 covers the outlet of the duct main body 210, and no cold air is discharged through the outlet 230 of the duct main body 210. That is, since it is not necessary to supply the cold air to the upper portion of the shelf 124 on which any stored goods such as food or the like are not put, the opening/closing piece 260 closes the outlet 230 of the duct main body 210.

Figure 6B:
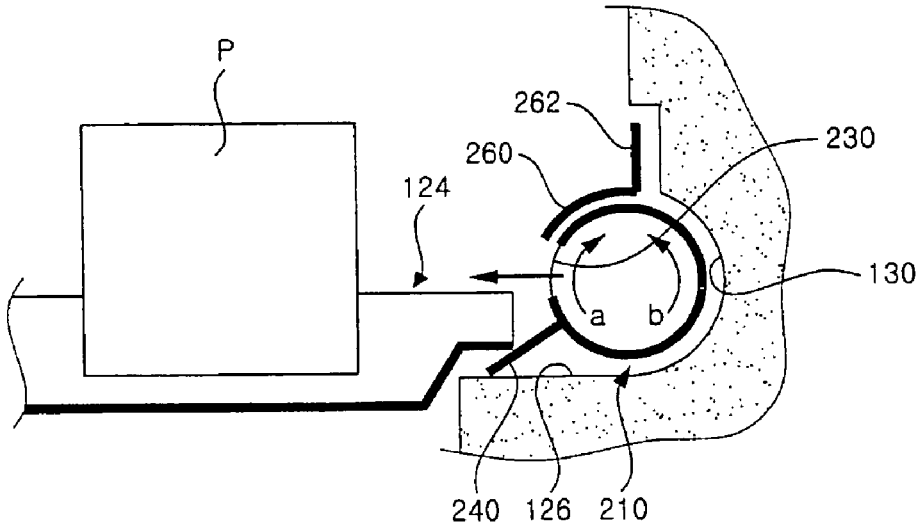

Further, as shown in FIG. 6*b*, if a load P such as food is applied to the upper portion of the shelf 124, the load P is transferred to the interlocking plate 240 through the shelf 124. Here, since the load P is larger than the elastic force of the elastic member 250, the interlocking plate 240 is lowered by a distance corresponding to a difference between their forces. The lowering of the interlocking plate 240 means that the duct main body 210 substantially pivots within a certain range.

When the duct main body 210 pivots on the pivotal shaft 242 in an arrow direction b of FIGS. 6*a* and 6*b*, the outlet 230 is opened. When the outlet 230 is opened, the cold air introduced into the duct main body 210 through the inlet 220 is discharged into the refrigerating chamber 120 through the outlet 230. At this time, since the cold air discharged through the outlet 230 is substantially directed to the upper portion of the shelf 124, it is supplied directly to the food P.

Here, FIG. 6*b* shows a state where the outlet 230 of the duct main body 210 is almost opened. In such a state, the interlocking plates 240 on which the side ends of the shelf 124 are seated are in contact with and supported on the upper surfaces of the shelf support portions 126 fixed to the both side surfaces of the refrigerating chamber. This means that the load P of the food put on the upper portion of the shelf 124 is larger than a predetermined value and thus, the supply of sufficient cold air is needed.

In addition, the pivoting angle of the duct main body 210 may be regarded as an opening degree of the outlet 230. Thus, the opening degree of the outlet 230 is substantially in proportion to the weight of the food put on the upper portion of the shelf 124. That is, in the present invention, it is understood that by properly setting the elastic coefficient of the elastic member 250, the opening degree of the outlet 230 can be controlled according to the weight of food put on the shelf 124.

According to the present invention, it is understood that if a relatively large amount of food is put on the shelf 124, a relatively large amount of cold air is supplied to the food. It is also understood that if an additional load is applied to the shelf, the outlet of the duct main body is more opened by a degree corresponding to the additional load, thereby intensively supplying the cold air to the food.

As described above, according to the present invention, the cold air is discharged to the upper portion of the shelf only when food is put on the shelf and the predetermined weight is applied. In addition, since the opening degree of the outlet is controlled in response to the weight of food put on the shelf, it is possible to control the amount of the cold air substantially supplied.

According to the cold air supply and control device for a refrigerator of the present invention described above in detail, the following advantages can be expected.

According to the cold air supply and control device of the present invention, it can be noted that among a plurality of shelves installed in the refrigerating chamber, cold air can be intensively supplied to a shelf on which food is put. Thus, there is an advantage in that by intensively supplying cold air to, for example, newly input food, the food can be rapidly stored in a cold state.

In addition, it is possible to control the amount of supplied cold air in response to a load according to the amount of food put on the shelf. Thus, among a plurality of shelves, a shelf on which a large amount of food is put can be supplied with a large amount of cold air, whereby there is an advantage in that it is possible to maximize refrigeration effects throughout the refrigerating chamber.

It will be apparent that the present invention is not limited to the embodiment described and illustrated above. Those skilled in the art may make various modifications and changes thereto.

For example, although the duct main bodies 210 are accommodated and installed in the mount groove portions 130 formed in the both side surfaces of the refrigerating chamber in the aforementioned embodiment, the duct main bodies 210 may be installed on the both side surfaces of the refrigerating chamber without being accommodated in the mount groove portions 130.

In addition, it will be apparent that various modifications may be made to the shape and the like of the duct main body 210 of the present invention. Further, it is possible to make various modifications to the features for pivotably supporting the duct main bodies 210 in the mount groove portions 130 or at the both side surfaces of the refrigerating chamber.

Further, although the present invention is described in connection with the example in which the duct main bodies 210 are installed within the refrigerating chamber in the aforementioned embodiment, the duct main bodies 210 may be substantially installed in the freezing chamber as well as the refrigerating chamber. That is, the cold air supply and control device according to the present invention may be installed in any storage space equipped with a shelf, such as the freezing chamber and refrigerating chamber.

What is claimed is:

1. A cold air supply and control device for a refrigerator, the refrigerator including a heat exchange chamber equipped with a heat exchanger to generate cold air, a storage space that stores goods using the cold air from the heat exchange chamber, and a plurality of shelves installed in the storage space, the cold air supply and control device comprising:

a duct main body comprising an inlet that allows the cold air generated in the heat exchange chamber to be introduced thereinto and an outlet that supplies the cold air introduced through the inlet to the storage space, the duct main body being pivotably installed on at least one of side surfaces of the storage space;

an opening and closing piece fixed to the at least one of the side surfaces of the storage space so as to selectively open and close the outlet in response to rotation of the duct main body;

an opening and closing device that rotates the duct main body in response to a weight of food put on a shelf of the plurality of shelves, adjacent to which the cold air supply and control device is positioned, in a direction in which the outlet is opened by the opening and closing piece; and an elastic device that rotates the duct main body in a direction in which the outlet is closed by the opening and closing piece.

2. The cold air supply and control device as claimed in claim 1, wherein the opening and closing device comprises an interlocking plate which is formed below the outlet of the duct main body and on which the shelf is seated, so that the opening and closing device rotates the duct main body in the direction in which the outlet is opened by the weight of the food put on the shelf.

3. The cold air supply and control device as claimed in claim 1, wherein the elastic device comprises a torsion spring installed between a front or rear surface of the duct main body and a corresponding surface of the storage space.

4. The cold air supply and control device as claimed in claim 1, wherein the duct main body is installed in a fore and aft direction on the at least one of the side surfaces of the storage space.

5. The cold air supply and control device as claimed in claim 1, wherein the duct main body is installed in a mount groove portion that is concavely formed in the at least one of the side surfaces of the storage space.

6. The cold air supply and control device as claimed in claim 1, wherein the duct main body is formed in a cylindrical shape.

7. The cold air supply and control device as claimed in claim 6, wherein the duct main body is installed pivotably on a pivotal shaft thereof.

8. The cold air supply and control device as claimed in claim 4, wherein the inlet is formed in a rear surface of the duct main body, and the outlet is formed in a side surface of the duct main body to supply the cold air toward the shelf.

9. The cold air supply and control device as claimed in claim 1, wherein the duct main body is configured to be installed in a mount groove portion that is concavely formed in the at least one of the side surfaces of the storage space, wherein the duct main body is formed in a cylindrical shape and wherein the mount groove portion has an arcuate cross section.

10. The cold air supply and control device as claimed in claim 2, further comprising a shelf support portion formed on the at least one of the side surfaces of the storage space at a position corresponding to a lower portion of the interlocking plate to support the shelf in a state in which the outlet of the duct main body is fully opened.

11. The cold air supply and control device as claimed in claim 1, wherein the outlet is formed to supply the cold air toward an upper portion of the shelf.

12. The cold air supply and control device as claimed in claim 11, wherein the outlet is formed to extend in a fore and aft direction corresponding to the shelf.

13. A cold air supply and control device for a refrigerator, the refrigerator including a heat exchange chamber equipped with a heat exchanger to generate cold air, a storage space that stores goods using the cold air from the heat exchange chamber, and a plurality of shelves installed in the storage space, the cold air supply and control device comprising:

a duct main body comprising an inlet that allows the cold air generated in the heat exchange chamber to be introduced thereinto and an outlet that supplies the cold air introduced through the inlet to the storage space; and an opening and closing device that opens and closes the outlet of the duct main body by rotating the duct main body in response to a load applied to a shelf of the plurality of shelves, adjacent to which the cold air supply and control device is positioned.

14. The cold air supply and control device as claimed in claim 13, wherein the outlet is formed to supply the cold air toward an upper portion of the shelf.

15. A cold air supply and control device for a refrigerator, the refrigerator including a heat exchange chamber equipped with a heat exchanger to generate cold air, a storage space that stores goods using the cold air from the heat exchange chamber, and a plurality of shelves installed in the storage space, the cold air supply and control device comprising:

a duct main body comprising an inlet that allows the cold air generated in the heat exchange chamber to be introduced thereinto and an outlet that supplies the cold air introduced through the inlet to the storage space, the duct main body being pivotably installed to at least one of side surfaces of the storage space;

a support device that supports a shelf of the plurality of shelves, adjacent to which the cold air supply and control device is positioned; and an opening and closing device that opens and closes the outlet by rotating the duct main body by a load of the shelf applied to the support device.

16. A refrigerator comprising the cold air supply and control device of claim 1.

17. A refrigerator comprising the cold air supply and control device of claim 13.

18. A refrigerator comprising the cold air supply and control device of claim 15.

* * * * *